US010170046B2

(12) United States Patent
Xie

(10) Patent No.: US 10,170,046 B2
(45) Date of Patent: Jan. 1, 2019

(54) OLED DISPLAY DEVICE AND METHOD FOR CORRECTING IMAGE STICKING OF OLED DISPLAY DEVICE

(71) Applicant: Boe Technology Group Co., Ltd., Beijing (CN)

(72) Inventor: Hongjun Xie, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 101 days.

(21) Appl. No.: 14/913,302

(22) PCT Filed: Aug. 14, 2015

(86) PCT No.: PCT/CN2015/087014
§ 371 (c)(1),
(2) Date: Feb. 19, 2016

(87) PCT Pub. No.: WO2016/150079
PCT Pub. Date: Sep. 29, 2016

(65) Prior Publication Data

US 2017/0039946 A1 Feb. 9, 2017

(30) Foreign Application Priority Data

Mar. 23, 2015 (CN) ..... 2015 1 0126192

(51) Int. Cl.
*G09G 3/3258* (2016.01)
*G09G 3/3233* (2016.01)

(52) U.S. Cl.
CPC ..... *G09G 3/3258* (2013.01); *G09G 3/3233* (2013.01); *G09G 2320/0233* (2013.01);
(Continued)

(58) Field of Classification Search
CPC .. G09G 3/3258; G09G 3/3233; G09G 3/3275; G09G 3/3225; G09G 3/3208;
(Continued)

(56) References Cited

U.S. PATENT DOCUMENTS 9,311,848 B2 * 4/2016 Keum ..... G09G 3/3233
9,390,656 B2 * 7/2016 Min ..... G09G 3/3233
(Continued)

FOREIGN PATENT DOCUMENTS

CN 1886774 12/2006
CN 101295466 10/2008
(Continued)

OTHER PUBLICATIONS

Office Action from China Application No. 201510126192.5 dated Feb. 14, 2017.
(Continued)

*Primary Examiner* — Fred Tzeng
(74) *Attorney, Agent, or Firm* — Calfee, Halter & Griswold LLP

(57) ABSTRACT

The embodiments of the present invention provide an OLED display device and a method for correcting image sticking of an OLED display device. The OLED display device comprises an OLED pixel array; a pixel detecting circuit for detecting aging degrees of respective OLED pixels in the OLED pixel array; wherein respective OLED pixel are aged by displaying an aging image on the OLED pixel array, such that the aging degrees of respective OLED pixels are the same; the brightness of each pixel in the aging image is inversely proportional to the aging degree of the pixel. According to the OLED display device and the method provided by the embodiments of the present invention, various approaches can be applied for detecting the aging degrees of respective OLED pixels in the OLED pixel array,
(Continued)

such that the image sticking of the OLED display device can be corrected by adjusting the aging degrees of respective OLED pixels.

17 Claims, 3 Drawing Sheets

(52) U.S. Cl.
CPC ..... *G09G 2320/0257* (2013.01); *G09G 2320/0295* (2013.01); *G09G 2320/043* (2013.01); *G09G 2320/045* (2013.01); *G09G 2320/0626* (2013.01)

(58) Field of Classification Search
CPC ..... G09G 3/325; G09G 3/3291; G09G 3/32; G09G 3/006
USPC ..... 345/690
See application file for complete search history.

(56) References Cited

U.S. PATENT DOCUMENTS 9,401,110 B2 * 7/2016 Lee ..... G09G 3/3208
9,443,473 B2 * 9/2016 Kwon ..... G09G 3/3275
2006/0244691 A1 * 11/2006 Lee ..... G09G 3/3233 345/76
2008/0048951 A1 * 2/2008 Naugler, Jr. ..... G09G 3/006 345/82
2008/0231557 A1 * 9/2008 Naugler ..... G09G 3/3225 345/76
2010/0073357 A1 * 3/2010 Min ..... G09G 3/3233 345/214
2011/0191042 A1 * 8/2011 Chaji ..... G09G 3/32 702/64
2013/0147693 A1 * 6/2013 Bae ..... G09G 3/3208 345/82
2014/0111567 A1 4/2014 Nathan et al.
2014/0118231 A1 * 5/2014 Yang ..... G09G 3/3258 345/82
2014/0152705 A1 * 6/2014 Kwon ..... G09G 3/3275 345/690
2015/0356924 A1 * 12/2015 Chen ..... G09G 3/3233 345/690
2016/0012798 A1 * 1/2016 Oh ..... G09G 3/325 345/205
2016/0098957 A1 * 4/2016 Eom ..... G09G 3/3225 345/78
2016/0163255 A1 * 6/2016 Kim ..... G09G 3/2003 345/212
2016/0171934 A1 * 6/2016 Yang ..... G09G 3/3291 345/212
2016/0275860 A1 * 9/2016 Wu ..... G09G 3/006

FOREIGN PATENT DOCUMENTS

CN 102047313 5/2011
CN 104021760 9/2014
CN 104036719 9/2014
CN 104318893 1/2015
CN 104680979 6/2015
DE 102010033286 A1 3/2012
EP 1071071 1/2001
JP J08211858 8/1996

OTHER PUBLICATIONS

International Search Report and Written Opinion from PCT/CN15/87014 dated Dec. 18, 2015.
Office action from Chinese Application No. 201510126192.5 dated Aug. 2, 2016.
Third Office Action from China Application No. 201510126192.5 dated Aug. 9, 2017.
Fourth Office Action from China Application No. 201510126192.5 dated Feb. 11, 2018.
Decision of Rejection for Chinese Patent Application No. 201510126192.5 dated Jul. 10, 2018.
Extended Search Report from European Patent Application No. 15831213.2 dated Jul. 4, 2018.

* cited by examiner

OLED DISPLAY DEVICE AND METHOD FOR CORRECTING IMAGE STICKING OF OLED DISPLAY DEVICE

RELATED APPLICATIONS

The present application is the U.S. national phase entry of PCT/CN2015/087014 with an International filing date of Aug. 14, 2015, which claims the benefit of Chinese Application No. 201510126192.5, filed Mar. 23, 2015, the entire disclosures of which are incorporated herein by reference.

FIELD OF THE INVENTION

The present invention relates to the field of display technology, particularly to an OLED display device and a method for correcting image sticking of an OLED display device.

BACKGROUND OF THE INVENTION

OLED (Organic Light-Emitting Diode) display is a kind of all solid state, active light emitting display. OLED display has the characteristics of high brightness, high contrast, ultra thin and light, low power consumption, unlimited visual angle range, wide working temperature range and so on, therefore it is considered as an emerging next generation display.

Active matrix OLED (AMOLED) display panel is very different with thin film transistor liquid crystal display (TFT-LCD) in the product characteristic. At present, for the development of the AMOLED display technology, a particularly prominent problem is the image sticking. The image sticking is related to the contour of the displayed image. Different displayed gray scales will cause a great difference between the drain currents of driving thin film transistors; meanwhile, the difference between the gate-source voltages (Vgs) of respective thin film transistors (TFT) causes different effects of voltage stress on respective thin film transistors; therefore, on the screen, different TFT threshold voltage (Vth) drifts may be generated for OLED pixels on the display, having a contour of the displayed image.

In addition, after a long-term use, the electro luminescent material of the OLED display will be aged, reducing the light emitting efficiency. This will also cause the image sticking of the OLED display.

SUMMARY OF THE INVENTION

In view of this, the embodiments of the present invention provide an OLED display device capable of correcting image sticking and a method for correcting image sticking of an OLED display device.

An embodiment of the present invention provides an OLED display device, the OLED display device comprises an OLED pixel array; characterized in that the OLED display device further comprises: a pixel detecting circuit for detecting aging degrees of respective OLED pixels in the OLED pixel array; wherein respective OLED pixels are aged by displaying an aging image on the OLED pixel array, such that the aging degrees of respective OLED pixels are the same; the brightness of each pixel in the aging image is inversely proportional to the aging degree of the pixel.

According to the OLED display device provided by the embodiments of the present invention, aging degrees of respective OLED pixels in the OLED pixel array can be detected with the pixel detecting circuit, such that the image sticking of the OLED display device can be corrected by adjusting the aging degrees of respective OLED pixels.

Optionally, the aging degrees of respective OLED pixels are indicated by a threshold voltage of a driver thin film transistor in respective OLED pixels; the pixel detecting circuit is arranged for obtaining the threshold voltage of the driver thin film transistor in respective OLED pixels.

In particular, the pixel detecting circuit obtains the threshold voltage of the driver thin film transistor in respective OLED pixels by detecting a current flowing through the driver thin film transistor.

Optionally, the aging degrees of respective OLED pixels are indicated by a voltage across an OLED in respective OLED pixels; the pixel detecting circuit is arranged for obtaining the voltage across the OLED in respective OLED pixels.

Optionally, the OLED display device further comprises a timing circuit for initiating the pixel detecting circuit with a predetermined time interval.

An embodiment of the present invention provides a method for correcting image sticking of an OLED display device, the OLED display device comprising an OLED pixel array; the method comprises: detecting aging degrees of respective OLED pixels in the OLED pixel array; and aging respective OLED pixels in the OLED pixel array, such that the aging degrees of respective OLED pixels are the same.

Optionally, aging respective OLED pixels in the OLED pixel array comprises: aging respective OLED pixels by displaying an aging image on the OLED pixel array; the brightness of each pixel in the aging image is inversely proportional to the aging degree of the pixel.

Optionally, detecting aging degrees of respective OLED pixels in the OLED pixel array comprises: detecting the aging degrees of respective OLED pixels in the OLED pixel array with a pixel detecting circuit.

Optionally, the aging degrees of respective OLED pixel are indicated by a threshold voltage of a driver thin film transistor in respective OLED pixels.

Optionally, the threshold voltage of the driver thin film transistor in respective OLED pixels is obtained by detecting a current flowing through the driver thin film transistor.

Optionally, the aging degrees of respective OLED pixels are indicated by a voltage across an OLED in respective OLED pixels.

Optionally, aging respective OLED pixels in the OLED pixel array comprises: detecting the aging degrees of respective OLED pixels in the OLED pixel array by optically imaging the OLED pixel array.

Optionally, the aging degrees of respective OLED pixels are indicated by a brightness of respective OLED pixels.

Optionally, the method further comprises: after the step of aging, increasing data line voltage and/or driving voltage corresponding to non-zero gray scales for respective OLED pixels.

Optionally, the steps of detecting and aging are performed with a predetermined time interval.

DETAILED DESCRIPTION OF THE INVENTION

The specific implementations of the OLED display device and the method for correcting image sticking of an OLED display device provided by the embodiments of the present invention will be explained in detail below with reference to the drawings.

An embodiment of the present invention provides an OLED display device, the OLED display device comprises an OLED pixel array; characterized in that the OLED display device further comprises: a pixel detecting circuit for detecting aging degrees of respective OLED pixels in the OLED pixel array; wherein respective OLED pixels are aged by displaying an aging image on the OLED pixel array, such that the aging degrees of respective OLED pixels are the same; the brightness of each pixel in the aging image is inversely proportional to the aging degree of the pixel.

According to the OLED display device provided by the embodiments of the present invention, aging degrees of respective OLED pixels in the OLED pixel array can be detected with the pixel detecting circuit, such that the image sticking of the OLED display device can be corrected by adjusting the aging degrees of respective OLED pixels.

For example, at least one parameter of a pixel, such as a threshold voltage of a driver thin film transistor or a voltage across an OLED, can be used to form an image sticking data of the pixel, thereby obtaining the image sticking data of respective pixels on the entire screen. An aging image can be obtained by reversing (and optionally, proportionally magnifying) the image sticking data of the pixel. The aging image is then displayed on the OLED display device for a predetermined time length, realizing the aging.

In the context of the present disclosure, the "aging degree" of an OLED pixel can be represented with a parameter relating to aging of the OLED pixel (for example, but not limited to a threshold voltage of a driver thin film transistor or a voltage across an OLED); similarly, the "aging degree" of an OLED pixel can also be represented with a normalized value or other converted values.

Figure 1A:
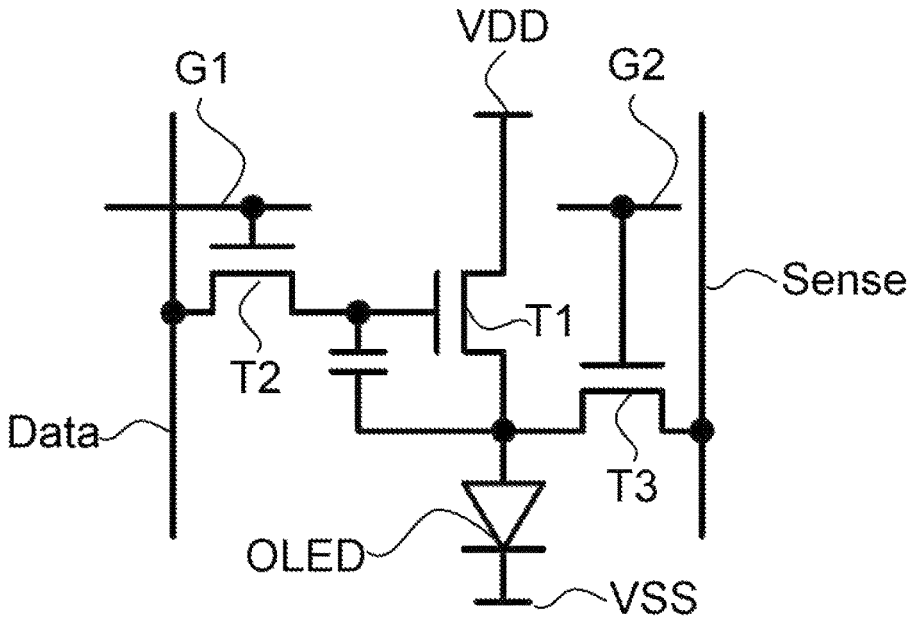
FIG. 1*a* is a schematic diagram of an OLED pixel circuit in an OLED display device according to an embodiment of the present invention.
Figure 1B:
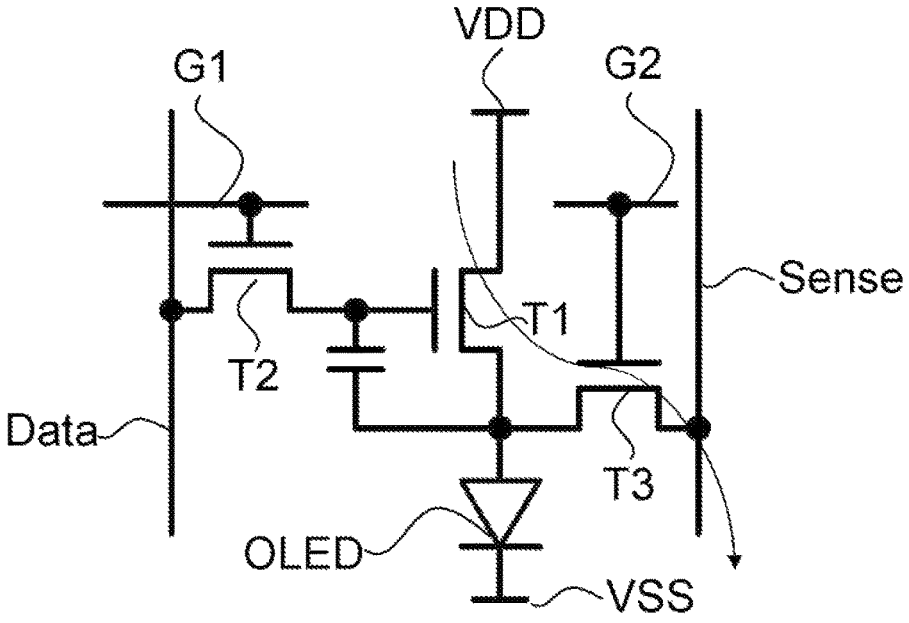
FIG. 1*b* shows detecting a current flowing through the driver thin film transistor by means of the OLED pixel circuit shown in FIG. 1*a;*
Figure 1C:
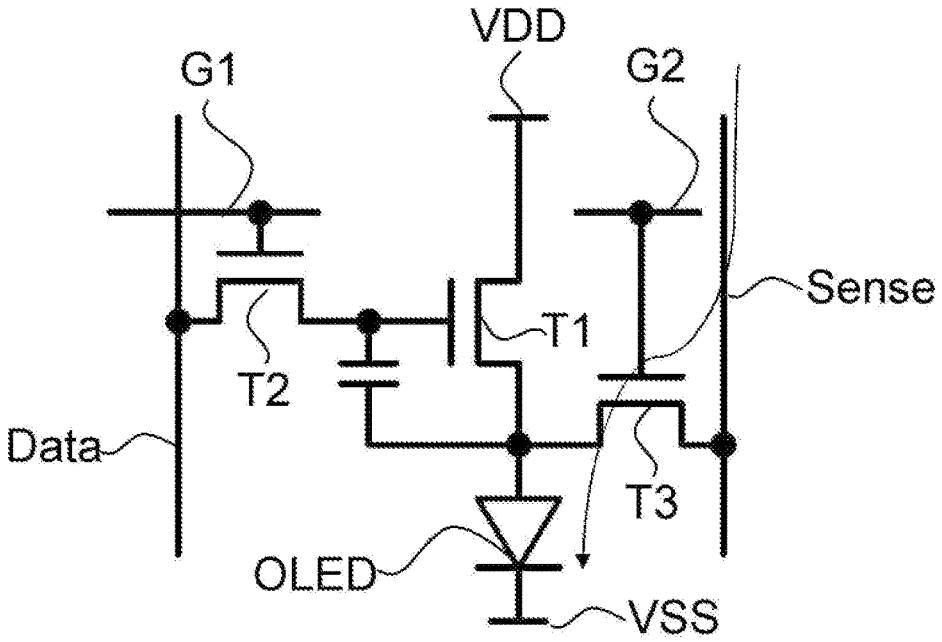
FIG. 1*c* shows detecting a voltage across an OLED in an OLED pixel by means of the OLED pixel circuit shown in FIG. 1*a;*

The pixel detecting circuits will be illustrated with the following nonrestrictive examples shown in FIGS. 1*a*-1*c*. As shown in FIG. 1*a*, in an OLED pixel circuit of an OLED display device: a drain voltage VDD is connected to a drain of a driver thin film transistor T1; a source of the driver thin film transistor T1 is connected to an end of an OLED; the other end of the OLED is connected to VSS; a scanning line G1 controls an addressing thin film transistor T2; a source of a switching thin film transistor T3 is connected to a source of the driver thin film transistor T1, a drain of T3 is connected to a sensing line Sense; and a scanning line G2 controls the switching thin film transistor T3.

In the existing technology, a sensing line Sense is usually used only for compensating the brightness of each OLED pixel in a form of external compensation, such that the brightness of respective OLED pixels tends to be consistent under the same gray scale. The inventor realized that by applying a detecting circuit such as the sensing line Sense, the electrical status of each OLED pixel can then be accurately and directly obtained; therefore, it is very suitable for detecting the aging degree of each OLED pixel.

As shown in FIG. 1*b*, the switching thin film transistor T3 can be switched on with the scanning line G2, so that a current of the driver thin film transistor T1 flows into the sensing line Sense through the switching thin film transistor T3 (as shown with the arrow in FIG. 1*b*). Therefore, the threshold voltage of the driver thin film transistor in each OLED pixel can be obtained by detecting the current flowing through the driver thin film transistor.

Therefore, optionally, the aging degrees of respective OLED pixels are indicated by a threshold voltage of a driver thin film transistor in respective OLED pixels; the pixel detecting circuit is arranged for obtaining the threshold voltage of the driver thin film transistor in respective OLED pixels.

In particular, the pixel detecting circuit obtains the threshold voltage of the driver thin film transistor in respective OLED pixels by detecting a current flowing through the driver thin film transistor.

As shown in FIG. 1*c*, the driver thin film transistor T1 can be switched off with the scanning line G1; the switching thin film transistor T3 can be switched on with the scanning line G2; meanwhile, a fixed current (as shown with the arrow in FIG. 1*c*) can be transferred with the sensing line Sense. In this way, the voltage of the sensing line Sense can be detected, thereby obtaining the voltage across the OLED.

Therefore, optionally, the aging degrees of respective OLED pixels are indicated by a voltage across an OLED in respective OLED pixels; the pixel detecting circuit is arranged for obtaining the voltage across the OLED in respective OLED pixels.

Though the pixel detecting circuits provided by the embodiments of the present invention are illustrated with FIGS. 1*a*-1*c*, those skilled in the art can understand that circuits with other forms capable of detecting a threshold voltage of a driver thin film transistor or a voltage across an OLED can also be applied into the embodiments of the present invention. For example, a same scanning line can be used to control the addressing thin film transistor T2 and the switching thin film transistor T3 in FIGS. 1*a*-1*c*.

Optionally, the OLED display device further comprises a timing circuit for initiating the pixel detecting circuit with a predetermined time interval. By initiating the pixel detecting circuit with a predetermined time interval, correcting the image sticking can then be realized automatically and flexibly.

An embodiment of the present invention also provides a method for correcting image sticking of an OLED display device, the OLED display device comprising an OLED pixel array; the method comprises: detecting aging degrees of respective OLED pixels in the OLED pixel array; and aging respective OLED pixels in the OLED pixel array, such that the aging degrees of respective OLED pixels are the same.

According to the method provided by the embodiments of the present invention, aging degrees of respective OLED pixels in the OLED pixel array can be detected, such that the image sticking of the OLED display device can be corrected by adjusting the aging degrees of respective OLED pixels.

Optionally, aging respective OLED pixels in the OLED pixel array comprises: aging respective OLED pixels by displaying an aging image on the OLED pixel array; the brightness of each pixel in the aging image is inversely proportional to the aging degree of the pixel.

For example, at least one parameter of a pixel, such as a threshold voltage of a driver thin film transistor or a voltage across an OLED, can be used to form an image sticking data of the pixel, thereby obtaining the image sticking data of respective pixels on the entire screen. An aging image can be obtained by reversing (and optionally, proportionally magnifying) the image sticking data of the pixel. The aging image is then displayed on the OLED display device for a predetermined time length, realizing the aging.

Figure 2:
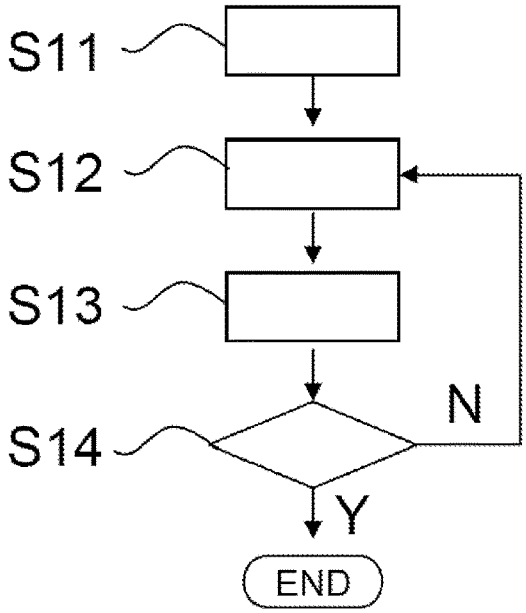
FIG. 2 is a flow chart of a method for correcting image sticking of an OLED display device according to an embodiment of the present invention.

Optionally, detecting aging degrees of respective OLED pixels in the OLED pixel array comprises: detecting the aging degrees of respective OLED pixels in the OLED pixel array with a pixel detecting circuit. FIG. 2 is a flow chart of a method for correcting image sticking of an OLED display device according to an embodiment of the present invention.

In this embodiment, the method for correcting image sticking of an OLED display device can comprise:

Step S11: detecting the aging degrees of respective OLED pixels in the OLED pixel array with a pixel detecting circuit (e.g., a threshold voltage of a driver thin film transistor or a voltage across an OLED);

Step S12: generating an aging image with aging degrees of respective OLED pixels;

Step S13: aging the OLED pixels in the OLED pixel array respectively with the aging image; and an optional Step S14: applying the pixel detecting circuit to determine whether the aging degrees of respective OLED pixels in the OLED pixel array are consistent; if the aging degrees of respective OLED pixels are not consistent, then Step S12 should be performed again. For example, if the maximum difference for the aging degrees of respective OLED pixels in the OLED pixel array is greater than 4% of the average aging degree, it can be considered that the aging degrees of respective OLED pixels are not consistent.

Therefore, optionally, the aging degrees of respective OLED pixel are indicated by a threshold voltage of a driver thin film transistor in respective OLED pixels.

Optionally, the threshold voltage of the driver thin film transistor in respective OLED pixels is obtained by detecting a current flowing through the driver thin film transistor.

Optionally, the aging degrees of respective OLED pixels are indicated by a voltage across an OLED in respective OLED pixels.

Figure 3:
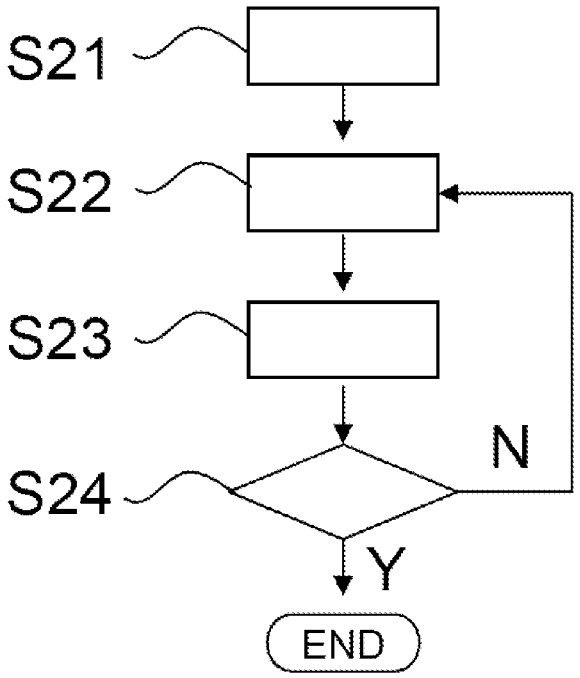
FIG. 3 is a flow chart of a method for correcting image sticking of an OLED display device according to another embodiment of the present invention.

Optionally, aging respective OLED pixels in the OLED pixel array comprises: detecting the aging degrees of respective OLED pixels in the OLED pixel array by optically imaging the OLED pixel array. FIG. 3 is a flow chart of a method for correcting image sticking of an OLED display device according to another embodiment of the present invention.

In this embodiment, the method for correcting image sticking of an OLED display device can comprise:

Step S21: detecting the aging degrees of respective OLED pixels in the OLED pixel array by optically imaging the OLED pixel array (e.g., brightness values of respective OLED pixels under a certain gray scale);

Step S22: generating an aging image with aging degrees of respective OLED pixels;

Step S23: aging the OLED pixels in the OLED pixel array respectively with the aging image; and an optional Step S24: optically imaging the OLED pixel array to determine whether the aging degrees of respective OLED pixels in the OLED pixel array are consistent; if the aging degrees of respective OLED pixels are not consistent, then Step S22 should be performed again. For example, if the maximum difference for the aging degrees of respective OLED pixels in the OLED pixel array is greater than 4% of the average aging degree, it can be considered that the aging degrees of respective OLED pixels are not consistent.

Therefore, optionally, the aging degrees of respective OLED pixels are indicated by a brightness of respective OLED pixels.

For example, if image sticking can be observed during the use of the AMOLED product, the AMOLED display can then be photographed with an optical device, so as to obtain the aging degrees of respective OLED pixels in the OLED pixel array.

Optionally, the method further comprises: after the step of aging (e.g., Step 13 in the embodiment shown in FIG. 2 or Step 23 in the embodiment shown in FIG. 3), increasing data line voltage and/or driving voltage corresponding to non-zero gray scales for respective OLED pixels, so as to restore the overall brightness of the OLED display device.

Optionally, the steps of detecting (e.g., Step 11 in the embodiment shown in FIG. 2 or Step 13 in the embodiment shown in FIG. 3) and aging (e.g., Step 13 in the embodiment shown in FIG. 2 or Step 23 in the embodiment shown in FIG. 3) are performed with a predetermined time interval. By performing the steps of detecting and aging with a predetermined time interval, correcting the image sticking can then be realized automatically and flexibly.

According to the OLED display device and the method provided by the embodiments of the present invention, various approaches can be applied for detecting the aging degrees of respective OLED pixels in the OLED pixel array, such that the image sticking of the OLED display device can be corrected by adjusting the aging degrees of respective OLED pixels.

Apparently, the skilled person in the art can make various modifications and variations to the present invention without departing from the spirit and scope of the present invention. In this way, provided that these modifications and variations of the present invention belong to the scopes of the claims of the present invention and the equivalent technologies thereof, the present invention also intends to cover these modifications and variations.

The invention claimed is:

1. An OLED display device, the OLED display device comprises an OLED pixel array; wherein the OLED display device further comprises:

a pixel detecting circuit for detecting aging degrees of respective OLED pixels in the OLED pixel array;

wherein respective OLED pixels are aged by displaying an aging image on the OLED pixel array, such that the aging degrees of respective OLED pixels are the same; a brightness of a pixel in the aging image corresponding to an OLED pixel in the OLED pixel array is inversely proportional to the aging degree of the OLED pixel.

2. The OLED display device as claimed in claim 1, wherein the aging degrees of respective OLED pixels are indicated by a threshold voltage of a driver thin film transistor in respective OLED pixels; the pixel detecting circuit is arranged for obtaining the threshold voltage of the driver thin film transistor in respective OLED pixels.

3. The OLED display device as claimed in claim 2, wherein the pixel detecting circuit obtains the threshold voltage of the driver thin film transistor in respective OLED pixels by detecting a current flowing through the driver thin film transistor.

4. The OLED display device as claimed in claim 1, wherein the aging degrees of respective OLED pixels are indicated by a voltage across an OLED in respective OLED pixels; the pixel detecting circuit is arranged for obtaining the voltage across the OLED in respective OLED pixels.

5. The OLED display device as claimed in claim 1, wherein the OLED display device further comprises:

a timing circuit for initiating the pixel detecting circuit with a predetermined time interval.

6. A method for correcting image sticking of an OLED display device, the OLED display device comprising an OLED pixel array and a pixel detecting circuit for detecting aging degrees of respective OLED pixels in the OLED pixel array;

wherein the method comprises:

detecting aging degrees of respective OLED pixels in the OLED pixel array; and aging respective OLED pixels in the OLED pixel array, such that the aging degrees of respective OLED pixels are the same;

wherein aging respective OLED pixels in the OLED pixel array comprises: aging respective OLED pixels by displaying an aging image on the OLED pixel array; a brightness of a pixel in the aging image corresponding to an OLED pixel in the OLED pixel array is inversely proportional to the aging degree of the OLED pixel.

7. The method as claimed in claim 6, wherein detecting aging degrees of respective OLED pixels in the OLED pixel array comprises:

detecting the aging degrees of respective OLED pixels in the OLED pixel array with a pixel detecting circuit.

8. The method as claimed in claim 7, wherein the aging degrees of respective OLED pixel are indicated by a threshold voltage of a driver thin film transistor in respective OLED pixels.

9. The method as claimed in claim 8, wherein the threshold voltage of the driver thin film transistor in respective OLED pixels is obtained by detecting a current flowing through the driver thin film transistor.

10. The method as claimed in claim 7, wherein the aging degrees of respective OLED pixels are indicated by a voltage across an OLED in respective OLED pixels.

11. The method as claimed in claim 7, wherein the steps of detecting and aging are performed with a predetermined time interval.

12. The method as claimed in claim 6, wherein aging respective OLED pixels in the OLED pixel array comprises:

detecting the aging degrees of respective OLED pixels in the OLED pixel array by optically imaging the OLED pixel array.

13. The method as claimed in claim 12, wherein the aging degrees of respective OLED pixels are indicated by a brightness of respective OLED pixels.

14. The method as claimed in claim 12, wherein the method further comprises:

after the step of aging, increasing data line voltage and/or driving voltage corresponding to non-zero gray scales for respective OLED pixels.

15. The method as claimed in claim 12, wherein the steps of detecting and aging are performed with a predetermined time interval.

16. The method as claimed in claim 6, wherein the steps of detecting and aging are performed with a predetermined time interval.

17. The method as claimed in claim 6, wherein the steps of detecting and aging are performed with a predetermined time interval.

* * * * *